US005662508A

United States Patent [19]

Smith

[11] Patent Number: 5,662,508

[45] Date of Patent: Sep. 2, 1997

[54] TOY BUILDING BLOCKS

[75] Inventor: Mark Andrew Smith, Anderson, Ind.

[73] Assignee: Inland Container Corporation, Indianapolis, Ind.

[21] Appl. No.: 556,079

[22] Filed: Nov. 13, 1995

[51] Int. Cl.[6] ..... A63H 33/08

[52] U.S. Cl. ..... 446/128; 446/488; 493/137; 493/959

[58] Field of Search ..... 446/85, 108, 109, 446/106, 125, 488, 128; 493/70, 136, 137, 139, 214, 959

[56] References Cited

U.S. PATENT DOCUMENTS

| | | | |
|---|---|---|---|
| 1,193,975 | 8/1916 | Beardsley | 446/109 |
| 2,751,705 | 6/1956 | Joseph | 446/488 |
| 3,368,316 | 2/1968 | Crowder | 446/109 |
| 3,581,431 | 6/1971 | Trenovan | 446/488 |
| 4,608,799 | 9/1986 | Hasegawa | 446/488 |
| 4,646,959 | 3/1987 | Sheffer | 446/488 |
| 4,930,681 | 6/1990 | Fultz et al. | 493/137 |
| 4,965,106 | 10/1990 | DeChristopher | 446/488 |
| 5,125,867 | 6/1992 | Solomon | 446/109 |

FOREIGN PATENT DOCUMENTS

| | | | |
|---|---|---|---|
| 2901245 | 7/1980 | Germany | 446/109 |
| 53507 | 11/1942 | Netherlands | 446/125 |

OTHER PUBLICATIONS

Pp. 39 and 40, Lillian Vernon Catalog–see Cat. No. 595769 on p. 40, and a copyright notice 1992 on p. 39.

Pp. 45 and 46, Lillian Vernon Catalog–see Cat. No. 595770 and a 1991 copyright notice on p. 46.

*Primary Examiner*—Michael A. Brown
*Assistant Examiner*—Jeffrey D. Carlson
*Attorney, Agent, or Firm*—Fitch, Even, Tabin & Flannery

[57] ABSTRACT

A toy building block is constructed by folding an integral paperboard blank. The toy building block includes locking tabs and complementary-shaped openings, with the tabs of one toy building block received in the openings of another toy building block.

7 Claims, 11 Drawing Sheets

Fig. 6
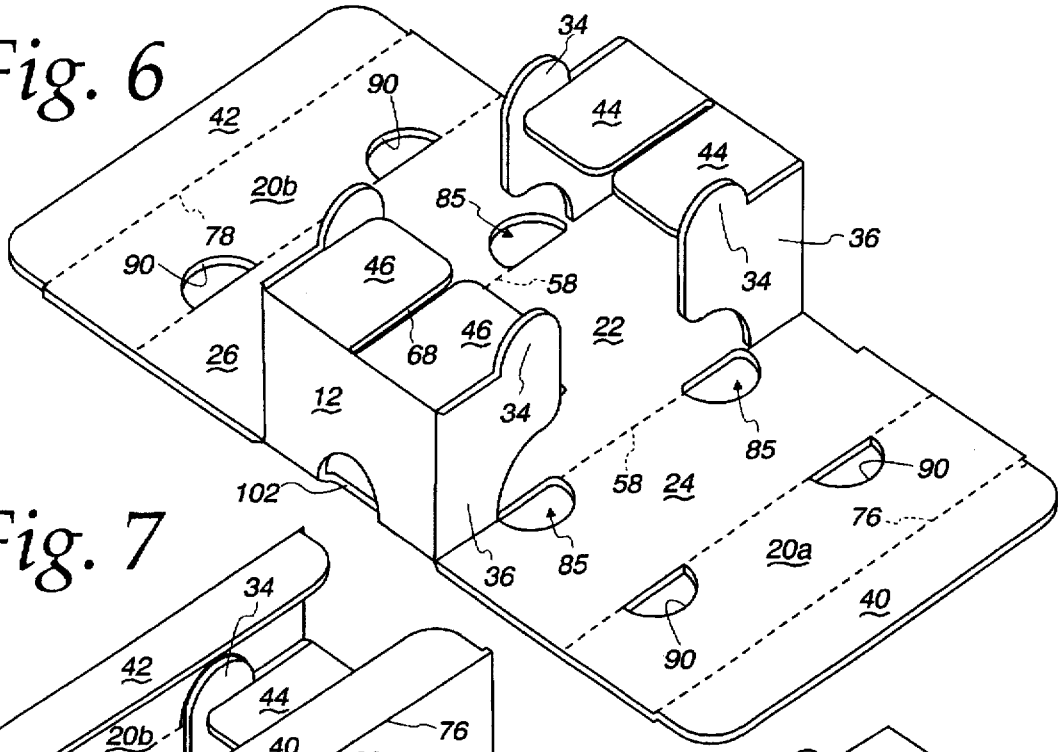
Fig. 7
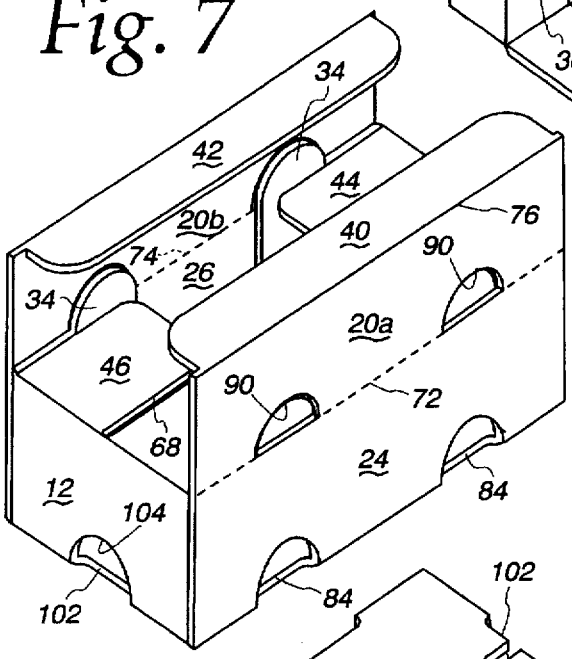
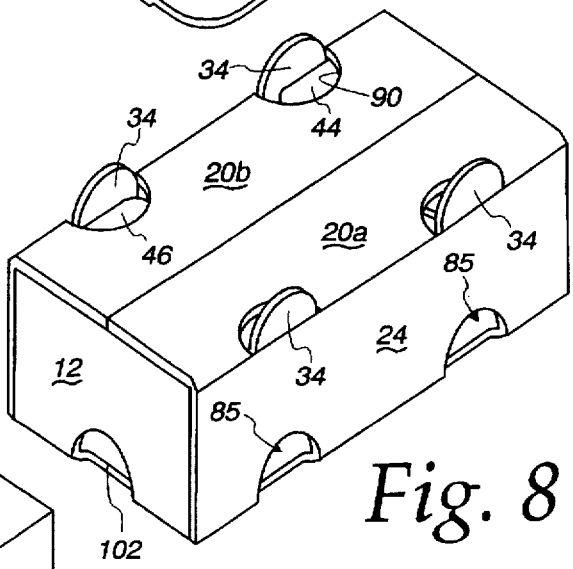
Fig. 8
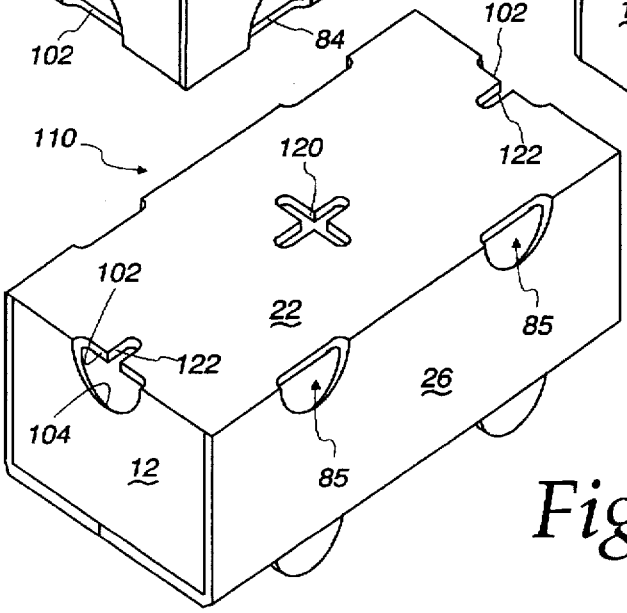
Fig. 9

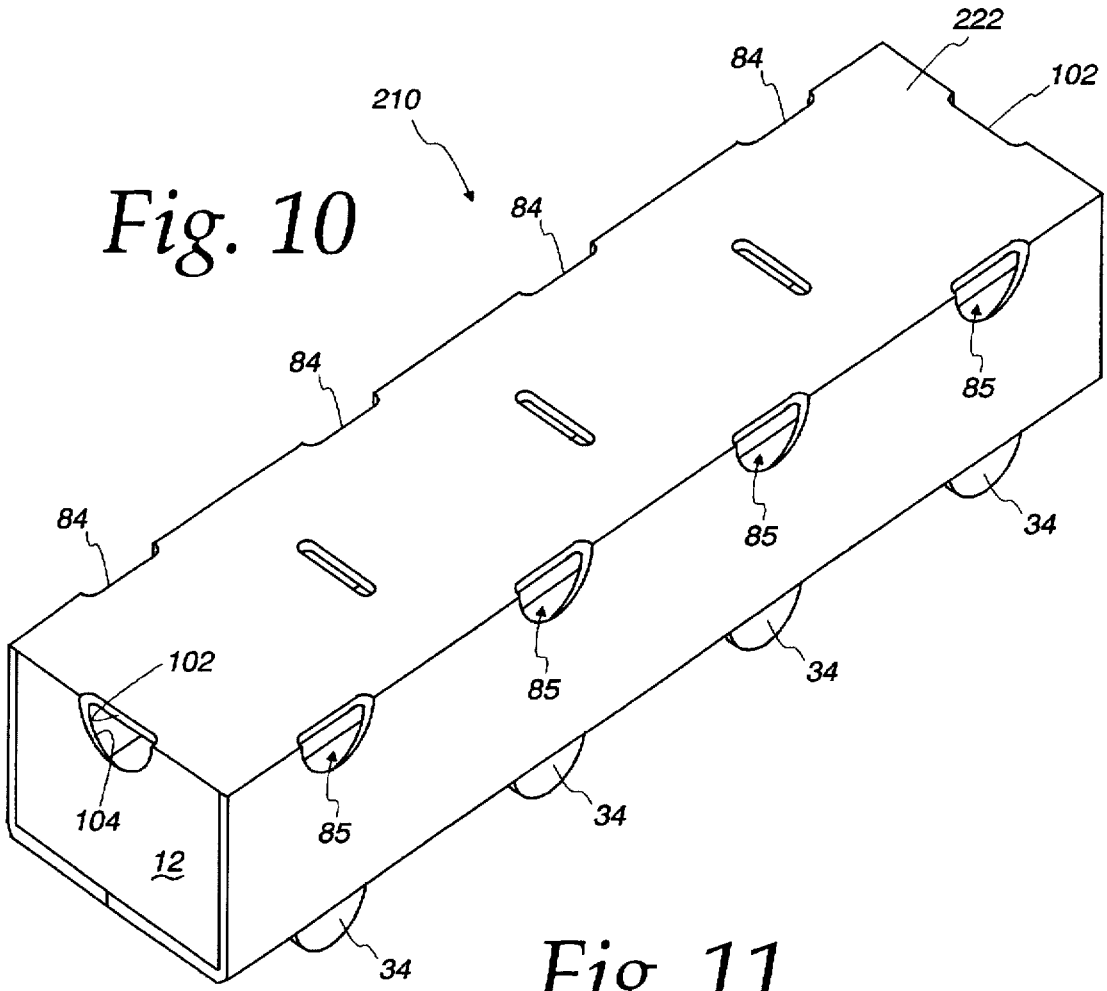
Fig. 10
Fig. 11
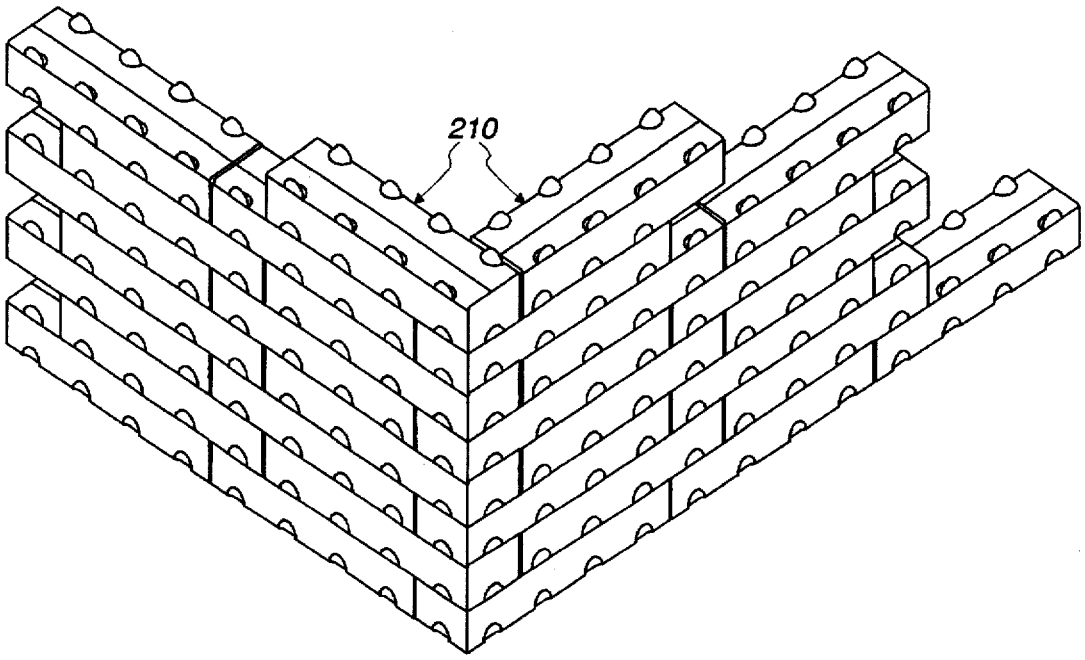

TOY BUILDING BLOCKS

BACKGROUND OF THE INVENTION

1. Field of the Invention

The present invention pertains to toy building blocks, and in particular to such blocks fabricated in the form of a paperboard carton.

2. Description of the Related Art

Toy blocks have been made from a variety of materials, including wood and plastics. Recently, large-sized blocks made of paper material, such as corrugated paperboard, have become available. Such blocks resemble small-sized cardboard cartons having six rectangular-surfaces. Such toy blocks are lightweight and easily grasped by youngsters, and accordingly, have been met with commercial acceptance. Nonetheless, refinements are continually being sought which will enhance their attractiveness to a user, especially one seeking to develop motor skills.

SUMMARY OF THE INVENTION

It is an object of the present invention to provide toy building blocks made of paperboard material.

It is another object of the present invention to provide toy building blocks having improved stability when stacked one on top of the other.

Yet another object of the present invention is to provide toy building blocks having improved interlocking ability when stacked in a two or three dimensional array.

These and other objects according to principles of the present invention are provided in an integral monolithic paperboard blank, folded to form a toy building block comprising:

first and second sidewalls comprising a first pair of opposed sidewalls, third and fourth sidewalls comprising a second pair of opposed sidewalls, the first and the second pair of opposed sidewalls cooperating to form a double-ended hollow tube;

a pair of opposed end walls at the ends of the tube and cooperating therewith to enclose an interior volume;

a plurality of tabs extending from the first sidewall and spaced apart in a preselected pattern, the second sidewall located opposite the first sidewall and defining a corresponding plurality of spaced apart primary apertures, arranged with the same pattern as that of the tabs; and the third and the fourth sidewalls defining a plurality of secondary apertures cooperating with the primary apertures to form a continuous opening for receiving the tabs of another identical paperboard box.

BRIEF DESCRIPTION OF THE DRAWINGS

FIGS. 4–8 are perspective views showing stages of folding the blank of FIG. 3 to erect the toy building block illustrated in FIG. 1;

FIG. 9 is a perspective view of an alternative embodiment of the toy building block;

FIG. 10 is a perspective view of an alternative embodiment of a toy building block;

FIG. 11 is a perspective view showing a plurality of the toy building blocks of FIG. 10 stacked together;

DETAILED DESCRIPTION OF THE PREFERRED EMBODIMENTS

Figure 1:
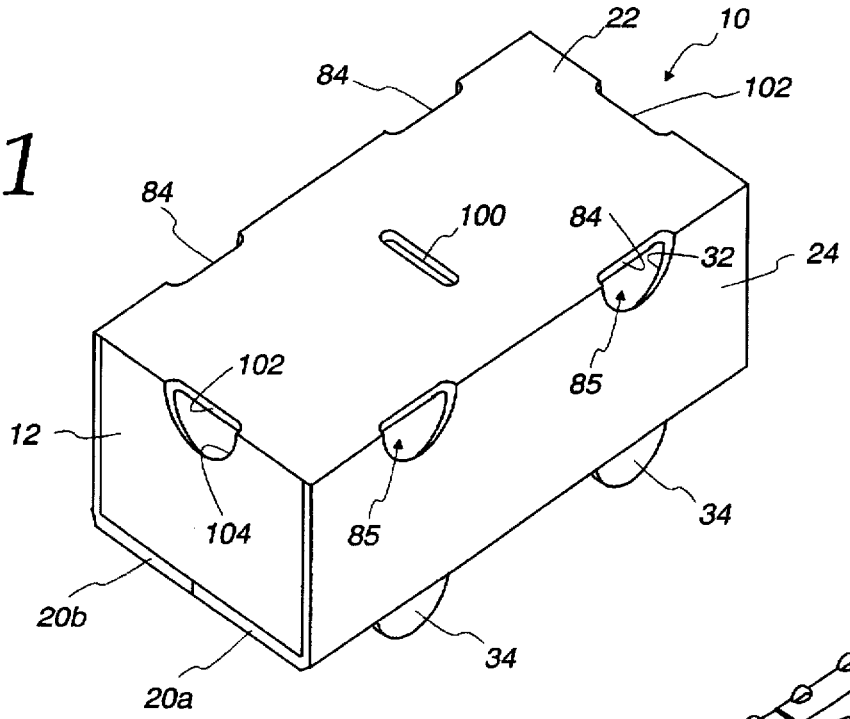
FIG. 1 is a perspective view of a toy building block according to principles of the present invention.
Figure 2:
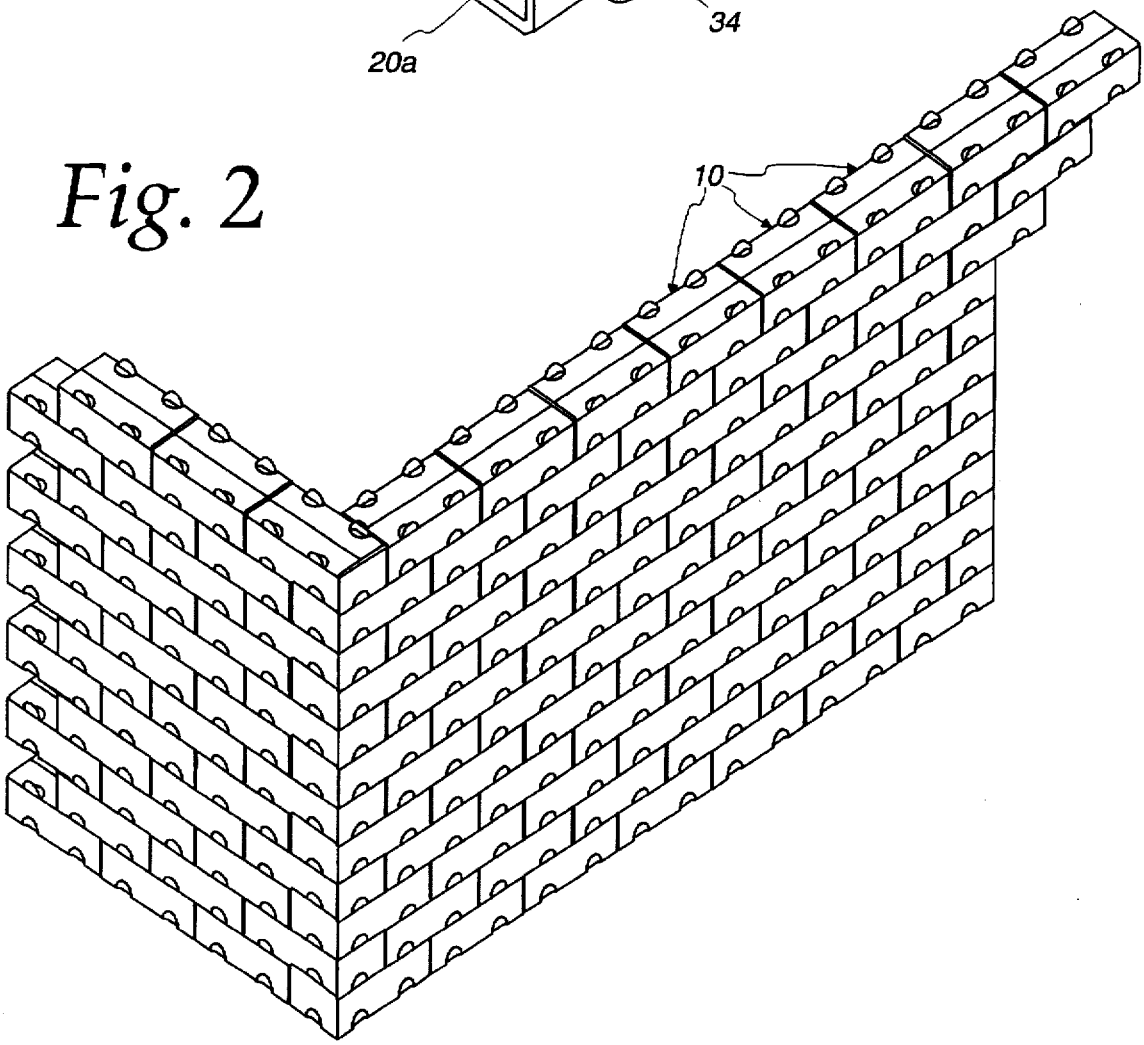
FIG. 2 shows a plurality of toy building blocks stacked together.
Figure 3:
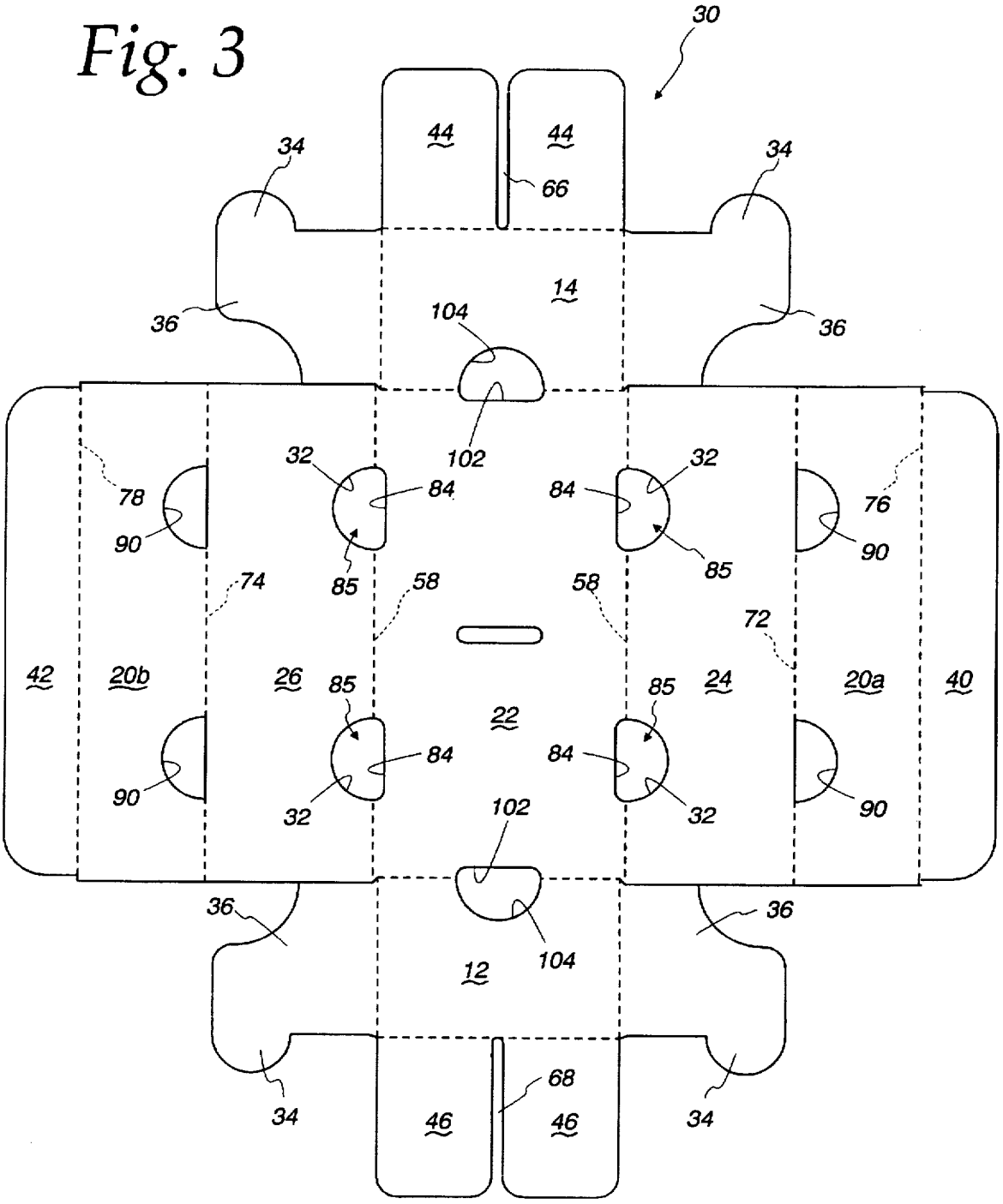
FIG. 3 is a top plan view of a blank from which the toy building block is erected.

Referring now to the drawings, and initially to FIGS. 1–3, a toy building block is generally indicated at 10. The toy building block 10 in effect comprises a paperboard box and includes a rectangular tube with end walls 12, 14. The tube is preferably comprised of first, second, third and fourth sidewalls 20–26. The sidewalls are preferably arranged in two pairs of opposed sidewalls. The first pair of opposed sidewalls includes sidewalls 20, 22. As can be seen in FIGS. 6–8, for example, sidewall 20 is preferably comprised of sidewall parts 20*a*, 20*b*, which are folded together to erect a tube from a cardboard blank 30 illustrated in FIGS. 3 and 4.

The remaining sidewalls 24, 26 are arranged on opposite sides of block 10 and include secondary recesses 32, dimensioned to receive tabs 34 which extend in a common direction from sidewall 20. As can be seen in FIG. 3, for example, tabs 34 are carried on interior walls 36, with a pair of interior walls 36 extending from opposite sides of a common end wall, 12 or 14.

Referring again to FIG. 3, the block 10 is preferably constructed from a single one-piece integral blank 30. In its preferred form, blank 30 has a sidewall 22 located at its center, with sidewalls 24, 26 flanking sidewall 20 on either side. Sidewall portions 20*a*, 20*b* are located aside the sidewalls 24, 26, respectively. Locking flaps 40, 42 are located aside the sidewall portions 20*a*, 20*b*, respectively.

The blank 30 has a cross shape, with end walls 12, 14 flanking the remaining sides of sidewall 20. A pair of spacer walls 44 extend from end wall 14, while spacer walls 46 extend from end wall 12. Interior walls 36 extend from the remaining opposed sides of end walls 12, 14. Blank 30 is erected in the manner illustrated in FIGS. 4–8. As indicated by arrows 50 in FIG. 4, end walls 12, 14 are folded about fold lines 52 to the erect position illustrated in FIG. 5. Next, the interior walls 36 are folded about fold lines 54 in the direction of arrows 56 so as to extend along fold lines 58, as shown in FIG. 6. The spacer walls 44, 46 are then folded about their respective fold lines 60, 62, so as to lie generally parallel to sidewall 22. The sidewalls 24, 26 are then folded about fold lines 58 to assume the upright position shown, for example, in FIG. 7.

Figure 4:
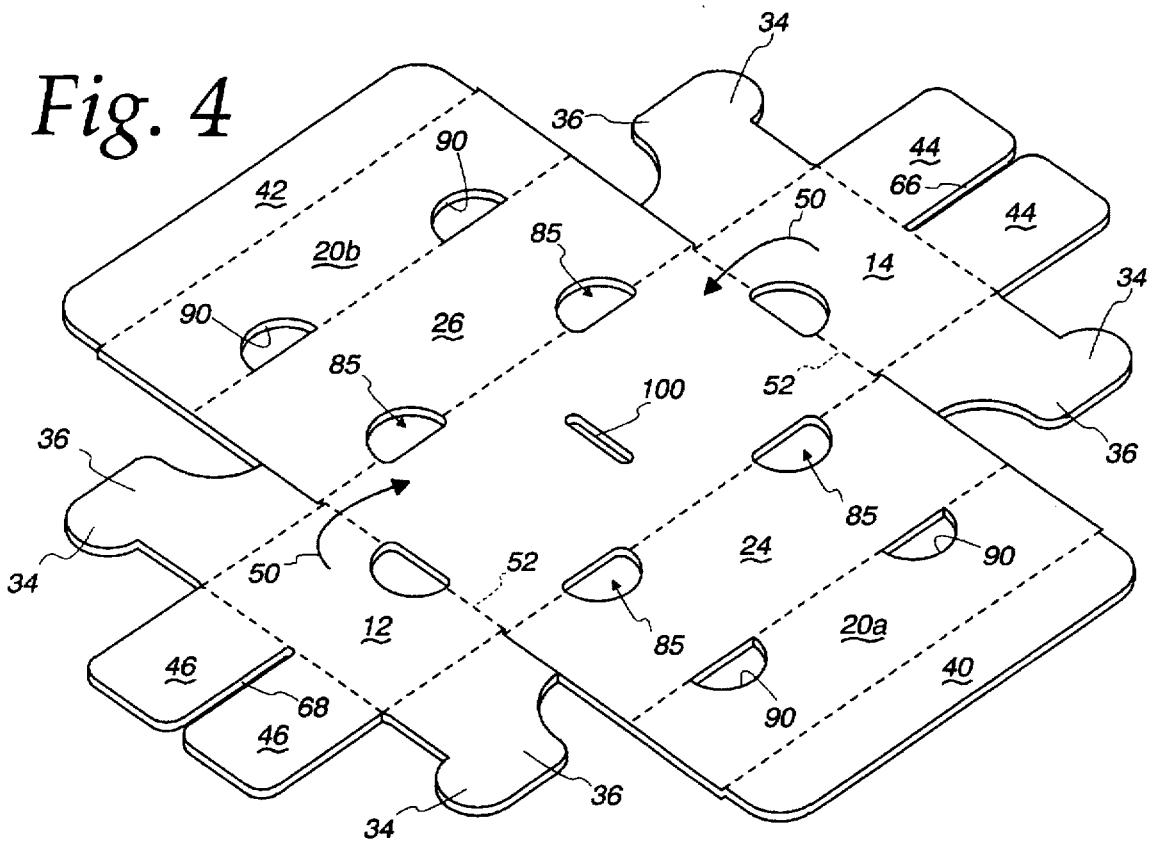
Figure 5:
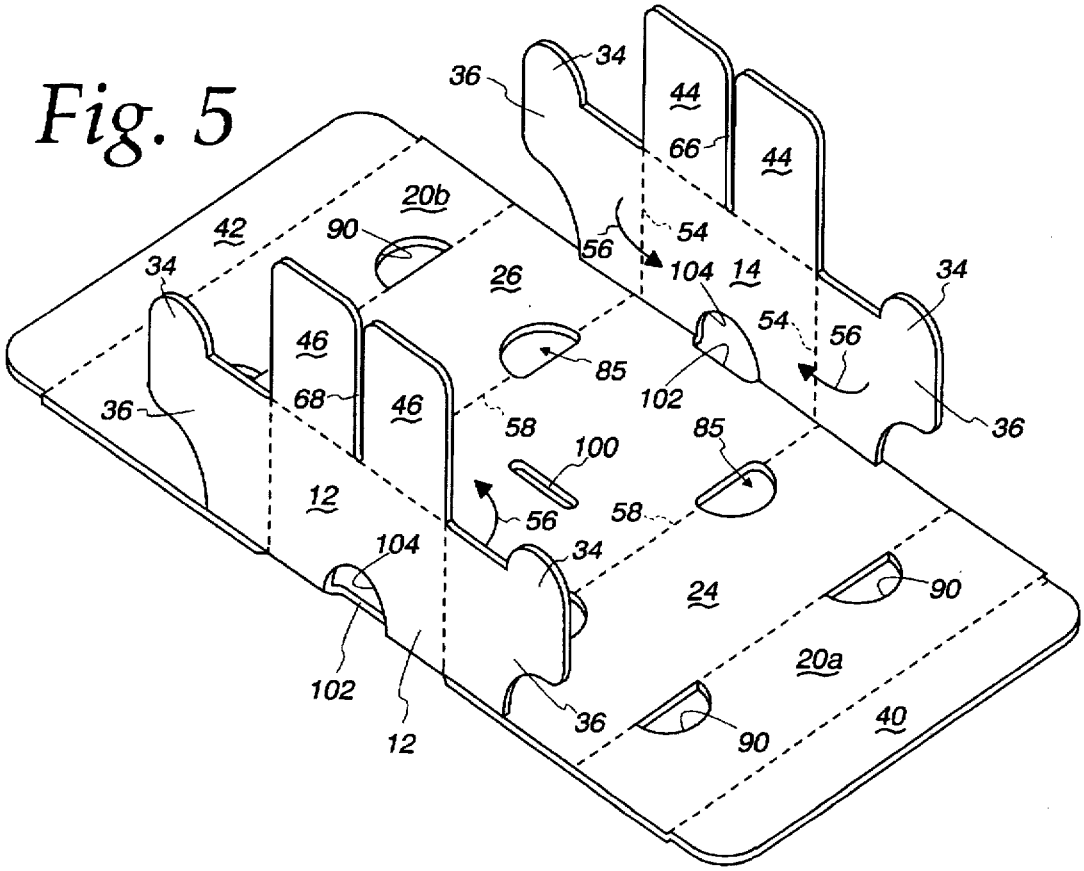

As can be seen, for example, in FIGS. 4 and 5, slots 66, 68 are formed between spacer walls 44 and spacer walls 46, respectively. Next, the sidewall portions 20*a*, 20*b* are folded about their respective fold lines 72, 74 so as to lie generally parallel to sidewall 20. The locking flaps 40, 42 are folded about their respective fold lines 76, 78 so as to be received in slots 66, 68, as shown in FIG. 8.

As can be seen, for example, in FIG. 3, the secondary recesses 32 formed in sidewalls 24, 26 lie outside the fold lines 58. Four primary recesses 84 are formed in sidewall 22, immediately adjacent the fold lines 58. The primary recesses 84 cooperate with the secondary recesses 32 to form continuous smooth-walled openings 85 in blank 30, as can be seen, for example, in FIG. 3. It should be understood that the primary recesses 84 lie to the inside of fold lines 58, whereas the secondary recesses 32 lie to the outside of the fold lines 58. As seen, for example, in FIG. 1, the secondary recesses 32 are formed in the vertically oriented sidewall 24, whereas the primary recesses 84 are formed in the horizontal sidewall 22. As can be seen, for example, at the upper end of FIG. 1, primary recesses 84 extend a substantial distance into the sidewall 22, preferably by an amount corresponding to twice the thickness of the paperboard blank 30. Referring to FIG. 2, when the blocks are stacked one on top of the other, the tabs 34 of one block are initially inserted into-primary recesses 84 of another block, and then pass into secondary recesses 32 of the other block. The secondary recesses 32 are preferably dimensioned for a close tolerance fit with the tabs 34 of an adjacent toy building block 10 so that, with any slight outward deformation of tabs 34 which may occur through rough use, tabs 34 will come to rest on the edges of the secondary recesses 32.

Referring again to FIGS. 4 and 5, the blank 30 further includes recesses 90 formed in sidewall portions **20*a* and 20*b*. Unlike the openings 85 formed by the combined secondary recesses 32 and primary recesses 84, recesses 90 preferably extend completely to one side of fold lines 72, 74 so as to lie entirely within sidewall portions 20*a* , 20*b*. The recesses 90 allow the sidewall portions 20*a*, 20*b* to clear the upstanding tabs 34 as enclosure walls 40, 42 are seated between the spacer walls 44, 46. As can be seen in FIGS. 8, for example, the spacer walls 44 abut the tabs 34 preventing their inward collapse toward each other. Further, the enclosure walls 40, 42 maintain the spacer walls 44, 46 in a desired orientation. In the preferred embodiment, the spacer walls 44 and 46 are sandwiched between enclosure walls 40, 42 and tabs 34. The interior walls 36 which carry the tabs 34 are preferably pressed against the sidewalls 24, 26. As can be seen in FIGS. 4 and 5, for example, the interior walls 36 are relatively massive compared to the tabs 34, and accordingly, the tabs are securely retained in position when block 10 is fully erected. Thus, the tabs 34** are secured in position with respect to the toy building block, and are maintained in position despite rough usage.

Referring again to FIGS. 1, an elongated linear slot 100 is formed in the middle of sidewall 22. Slot 100 is formed in line with apertures 102, formed in sidewall. 22 and recesses 104, formed in end walls 12, 14. Openings formed by the cooperation of apertures 102 and recesses 104 is the same as that described above with respect to primary recesses 84 and secondary recesses 32. For example, the apertures 102 and slot 100 cooperate to receive vertically adjacent toy building blocks arranged at right angles to the block illustrated in FIG. 1, for example. The slot 100 is preferably dimensioned to have a width approximately four times the thickness of blank 30, to thereby accommodate a laterally adjacent pair of blocks arranged at right angles to the block illustrated in FIG. 1. A tab 34 of an overlying block will be received in slot 100 with a laterally opposed tab 34 received in an aperture 102 and a recess 104.

Turning now to FIGS. 9 and 10, an alternative embodiment of the toy building block is generally indicated at 110. The toy building block 110 is generally the same as block 10 above, except for an X-shaped slot 120 formed in its upper sidewall 22, and opposed slots 122 extending from edges defining apertures 102. Accordingly, the toy building block 110 can receive overlying toy building blocks oriented in generally the same manner, except for being laterally offset by an amount corresponding to generally one-half the distance between opposed sidewalls 24, 26.

Referring now to FIG. 10, a toy building block 210 bears many of the features described above for the toy building block 10. Whereas the toy building block 10 has two tabs 34 on the side, the toy building block 210 has four tabs. As with the toy building block 10, it is generally preferred that an equal number of openings 85 be provided, so as to receive the tabs of a similar toy building block disposed thereabove. Accordingly, four openings 85 are provided on each sidewall 224, 226 of toy building block 210. Three elongated linear slots 291 are provided in sidewall 222. As with the toy building block 10, the toy building block 210 preferably includes a number of elongated linear slots 291 equal to one less than the number of openings 85 which appear on a given side of the toy building block.

Figure 12:
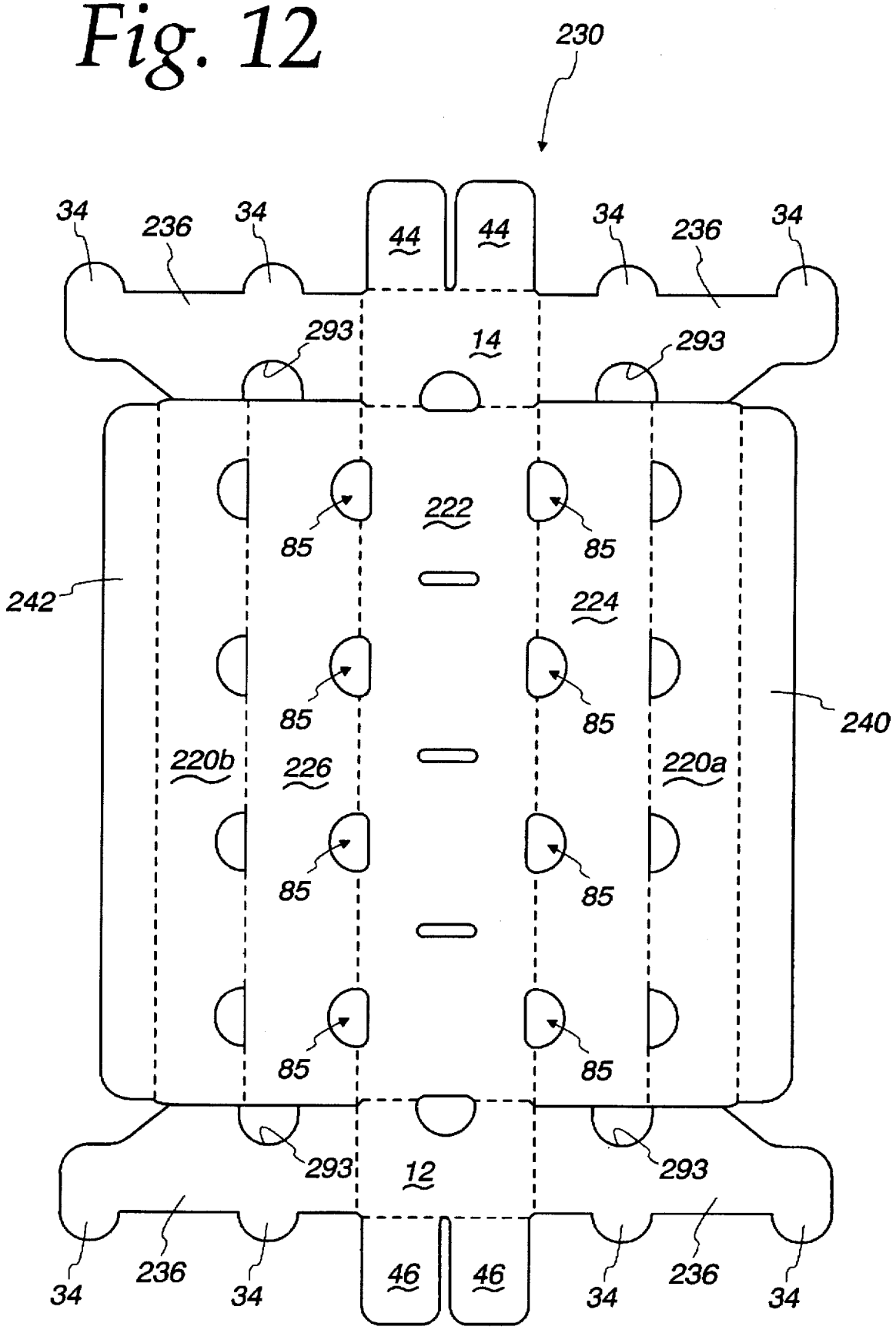
FIG. 12 is a top plan view of the blank from which the toy building block of FIG. 11 is constructed.
Figure 13:
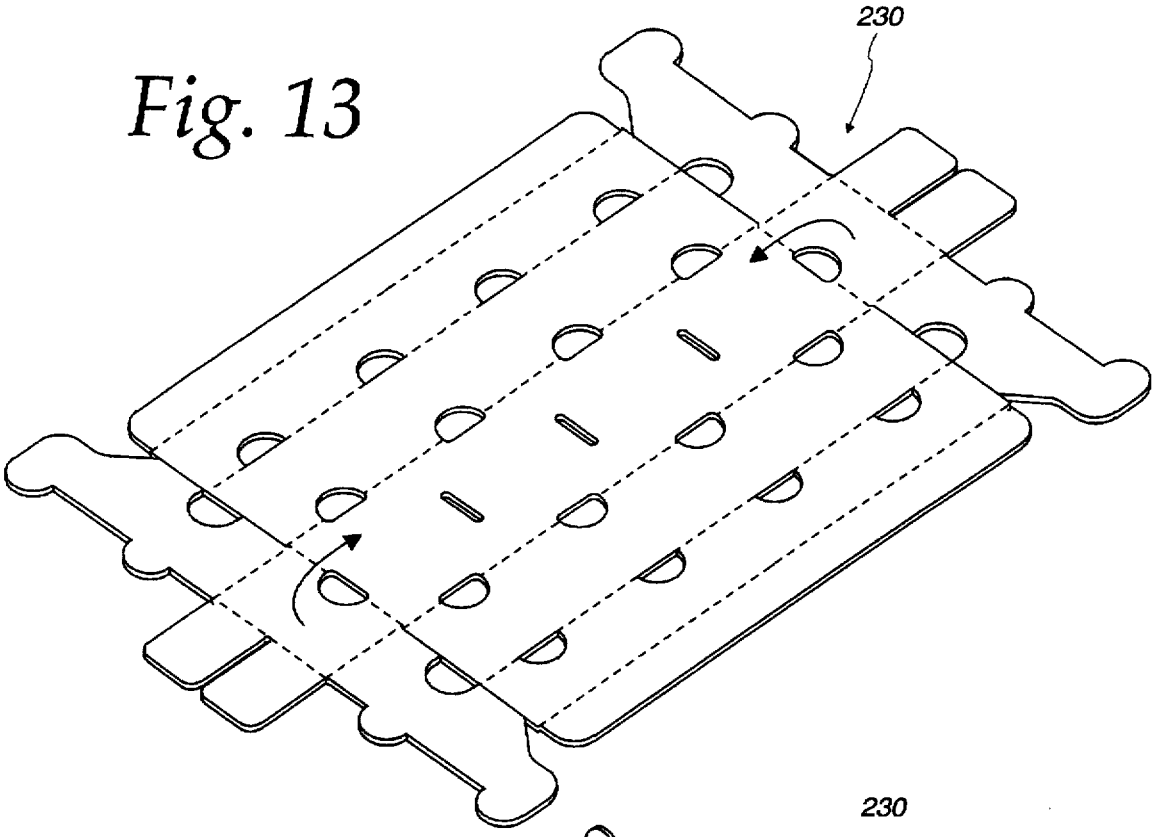
FIGS. 13–17 are perspective views showing the stages of folding the paperboard blank of FIG. 12.
Figure 14:
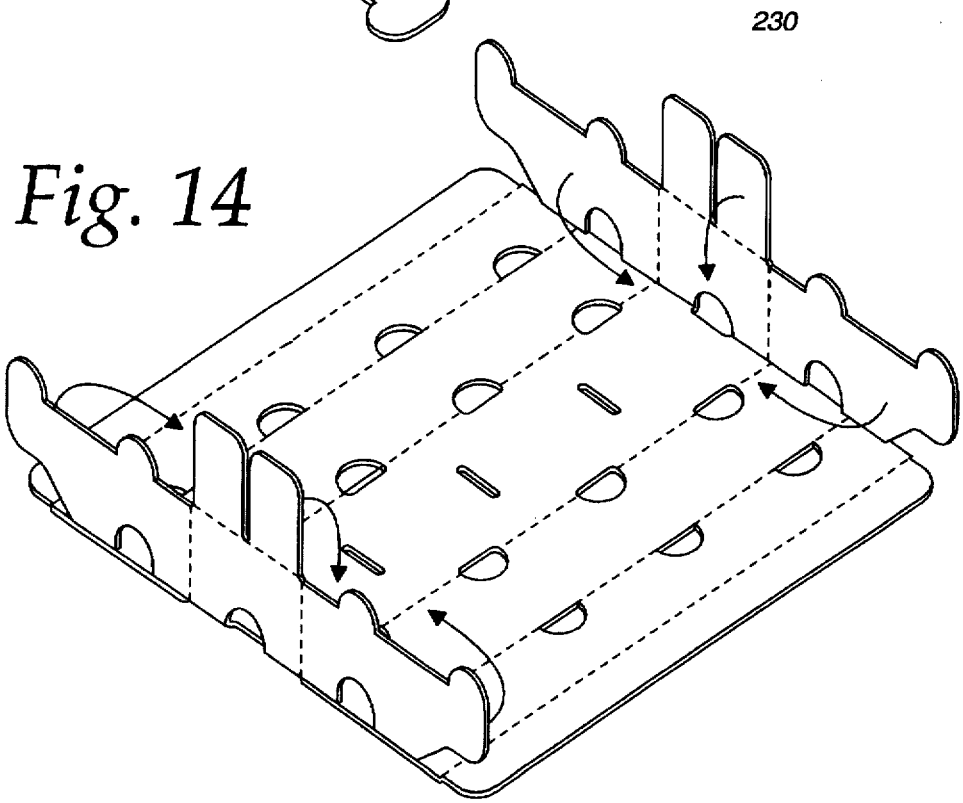
Figure 15:
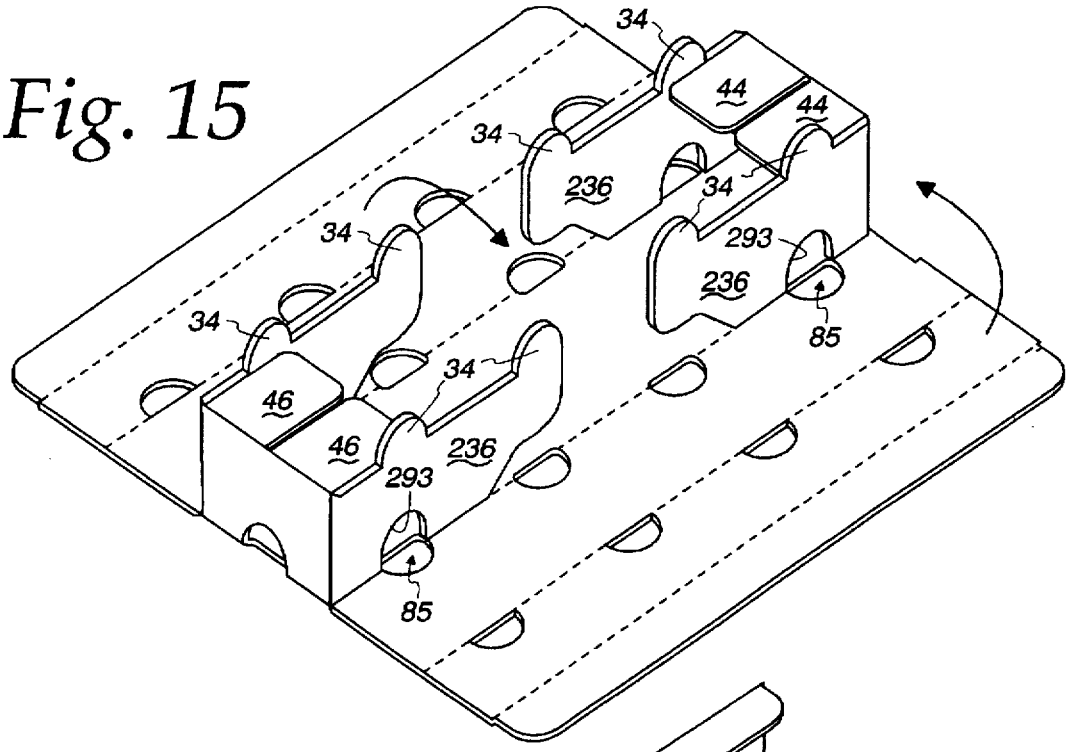
Figure 16:
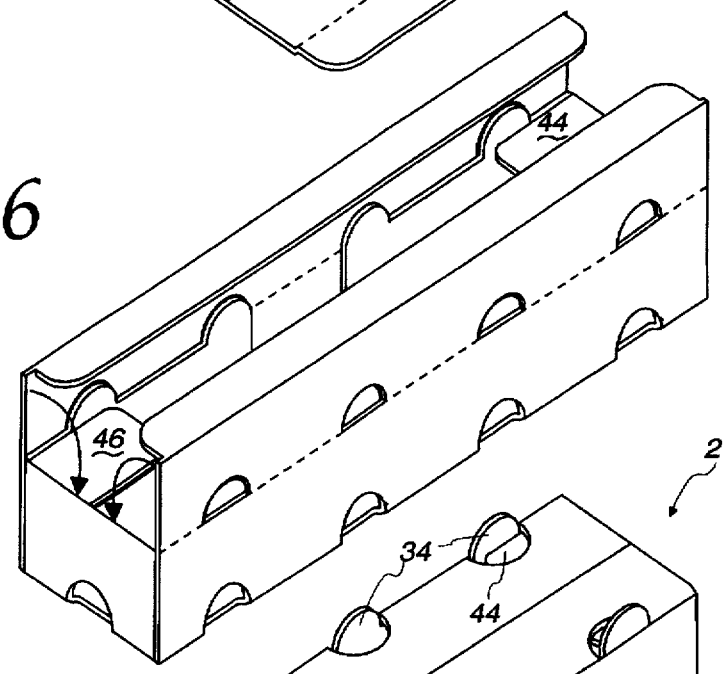
Figure 17:
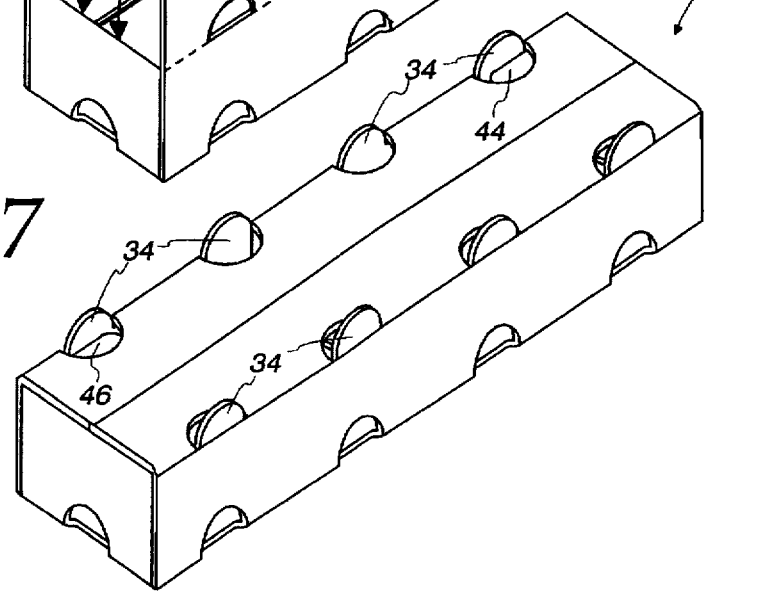
Figure 18:
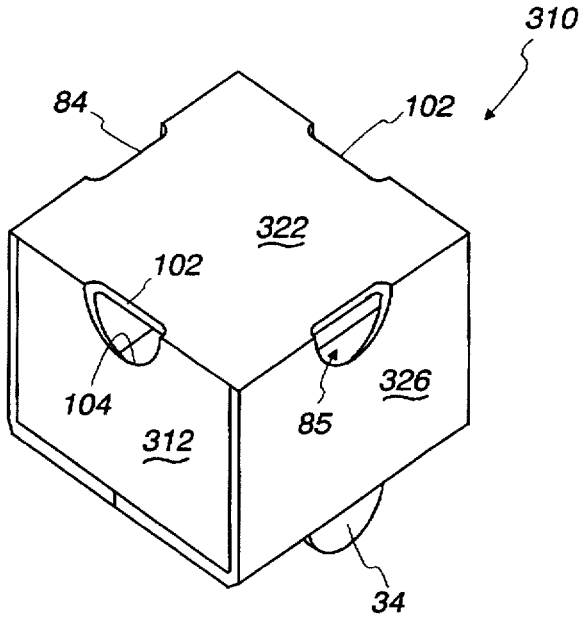
FIG. 18 is a perspective view of another embodiment of a toy building block according to principles of the present invention.

Referring now to FIG. 12, a paperboard blank 230, from which the toy building block 210 is constructed, is shown. The similarities between the spacing and relative proportion of the portions of the paperboard blanks 30 and 230 can be seen by comparing. FIGS. 3 and 4. The end walls 12, 14 and spacer walls 44, 46 are identical in the two embodiments. However, the support walls 236, shown in FIG. 12, differ from the support walls 36 shown in FIG. 3. For example, the support walls 236 in FIG. 12 each include a pair of tabs 34. Further, the support walls 236 include openings 293 which provide clearance for tabs of another building block which are inserted in the end openings 85 (see for example FIG. 15). FIGS. 13–16 show the erection of toy building block 210 from the paperboard blank 230. Arrows in the various figures show the folding of parts of paperboard blank 230. It will be seen that the sequence of erection is similar to that of the toy building block 10 described above. FIG. 17 is a bottom perspective view showing the completed toy building block 210. As can be seen in FIGS. 15 and 17, only the outermost or end tabs 34 are supported by spacer walls 44, 46. In the preferred embodiment 210, the spacer walls 46 are of identical size to the spacer walls of toy building block 10, whereas in toy building block 210 four tabs are carried at each end of the toy building block. Thus, lateral support for the innermost four tabs 34 of toy building block 210 relies upon the strength of the internal wall 236. If desired, the spacer walls 44, 46 can be elongated so as to overlie both tabs 34 of an internal wall 236.

Figure 19:
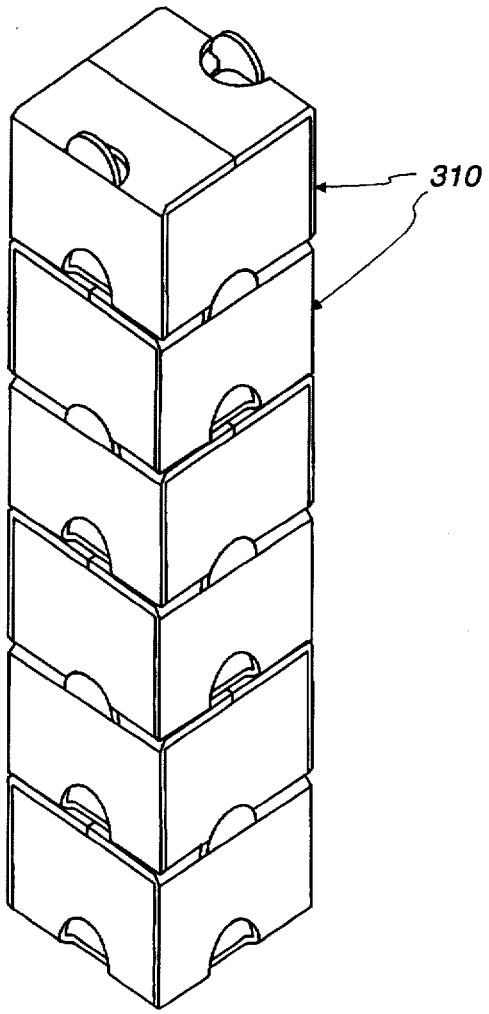
FIG. 19 shows a plurality of the toy building blocks of FIG. 18 stacked together.

Turning now to FIGS. 18–25, a further embodiment of toy building block is generally indicated at 310. Unlike the preceding embodiments, toy building block 310 does not have multiple tabs 34 or openings 85 on its sides. Rather, toy building block 310 has only a single tab 34 and a single opening 85 on its sides. The other features of toy building block 310 are similar to those of toy building block 10, described above. FIG. 19 shows a plurality of toy building blocks 310, stacked one on top of the other. As shown in FIG. 19, the toy building blocks can be rotated 90 degrees in plan view and still be capable of interlocking with an underlying, differently rotated but similar toy building block.

Figure 20:
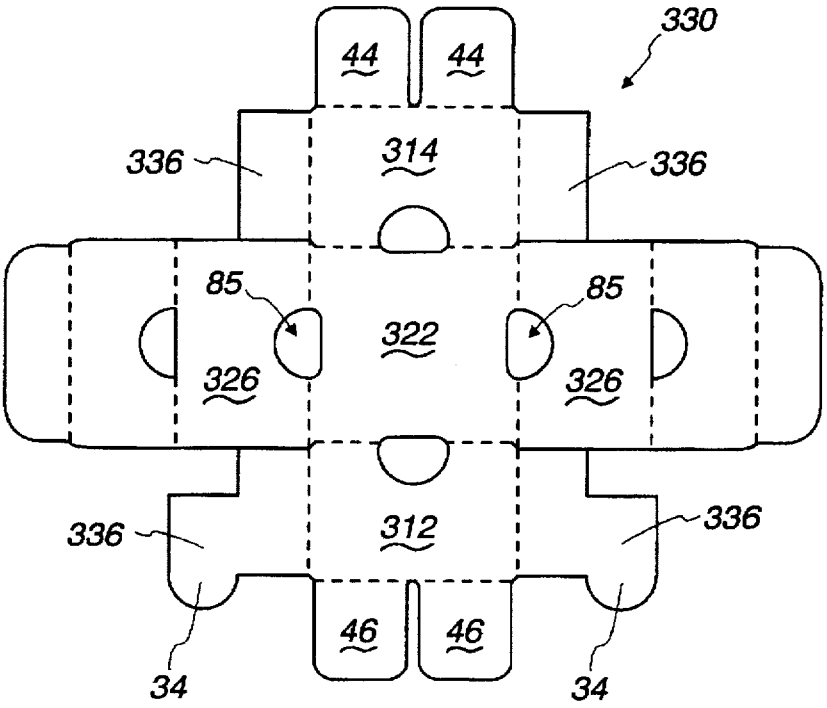
FIG. 20 shows a top plan of a paperboard blank from which the toy building block of FIG. 18 is constructed.
Figure 21:
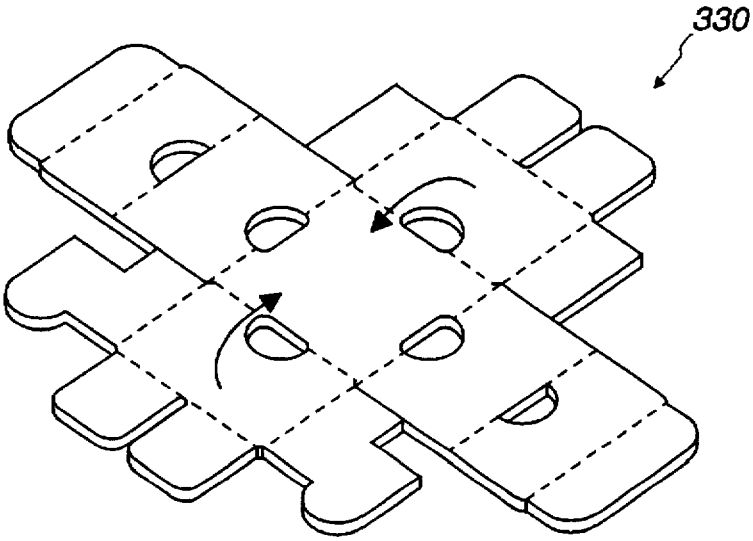
FIGS. 21–25 are perspective views showing the stages of constructing the toy building blocks of FIG. 18.
Figure 22:
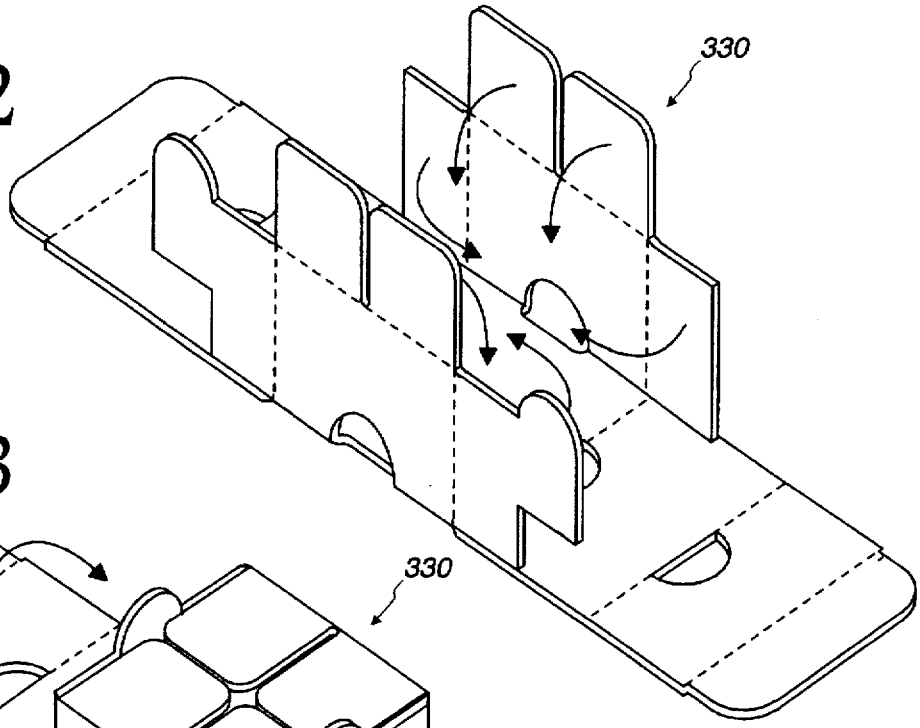
Figure 23:
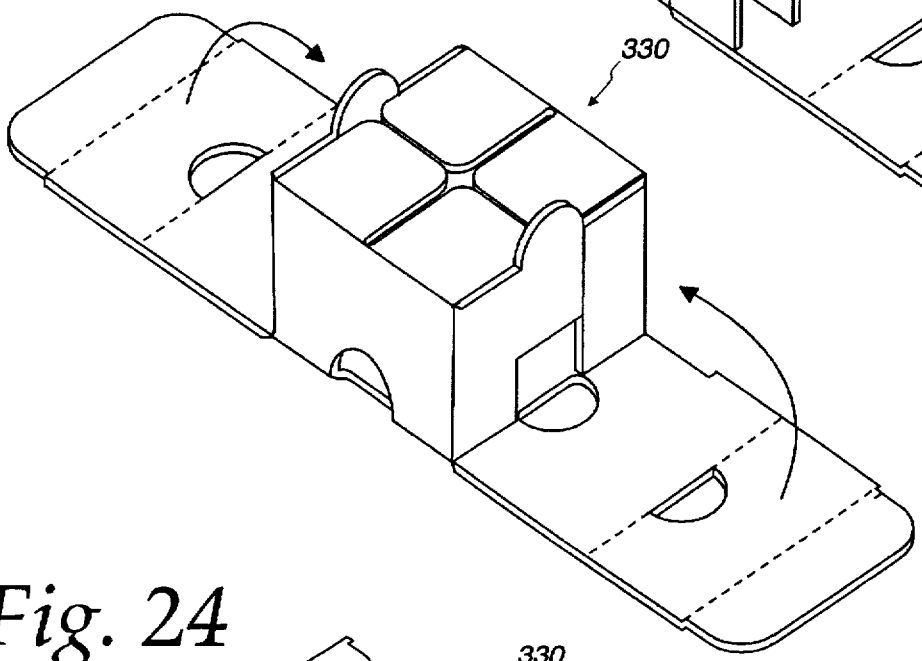
Figure 24:
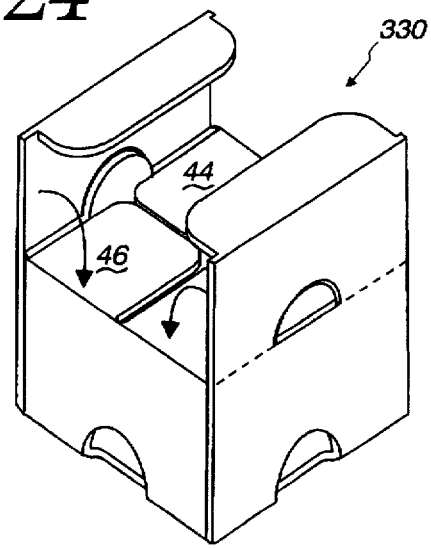
Figure 25:
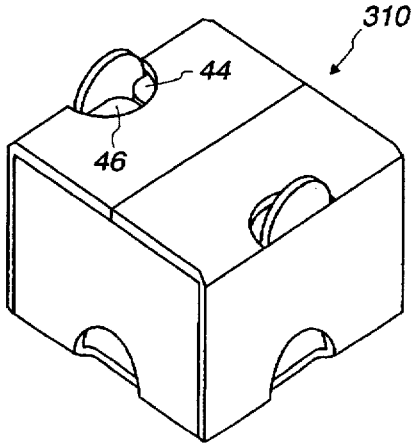

Referring to FIG. 20, an integral paperboard blank 330, from which toy building block 310 is constructed, is shown. The paperboard blank 330 has tabs 34 extending only from one pair of internal walls 336. The other pair of internal walls 336, shown at the top of FIG. 20, do not carry tabs 34. Thus, the paperboard blank 330 is not symmetric about a horizontal centerline drawn through the center of FIG. 20. FIGS. 21–24 show the erection of toy building block 310 from the paperboard blank 330. A bottom perspective view of toy building block 310 is shown in FIG. 25. As can be seen in FIG. 25 as well as in FIG. 24, the tab 34 is supported by a pair of support walls, a support wall 44 and a support wall 46.

As can be seen from the above, a fiberboard container formed as a toy building block can be economically fabricated using automated die cut techniques and can be readily scaled for a variety of different sizes. Construction of the toy building block can be accomplished without external devices such as glue, tape, staples or other fastening means and can be readily erected by those having minimal skills and little or no previous experience. The toy building block has improved nesting features provided by interengaging tabs and slots, which allows the toy building blocks to be stacked one on top of the other to achieve structures of substantial height exhibiting a remarkable improvement in interlocking strength. With slots formed on the major walls of the toy building blocks, blocks can be oriented at right angles to one another and can be interwoven from one stacking level to another, with the end of one toy building block lying against the medial portion of another toy building block.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A box comprising an integral monolithic paperboard blank, folded to form a toy building block comprising:

first and second sidewalls comprising a first pair of opposed sidewalls, third and fourth sidewalls comprising a second pair of opposed sidewalls, the first and the second pair of opposed sidewalls cooperating to form a double-ended hollow tube;

a pair of opposed end walls at the ends of the tube and cooperating therewith to enclose an interior volume;

a plurality of tabs extending from the first sidewall and spaced apart in a preselected pattern, the second sidewall located opposite the first sidewall and defining a corresponding plurality of spaced apart primary apertures, arranged with the same pattern as that of the tabs;

the third and the fourth sidewalls defining a plurality of secondary apertures cooperating with the primary apertures to form a continuous opening for receiving the tabs of another paperboard box; and two spaced-apart pairs of spaced-apart interior walls, carrying the tabs, the third and the fourth sidewalls completely overlying the first pair of opposed interior walls.

2. The box of claim 1 further comprising spacer walls carried by the end walls, and positioned between the tabs to press the tabs against the third and the fourth sidewalls.

3. The toy building block of claim 1 wherein the second sidewall defines at least one recess formed to receive tabs of another paperboard box.

4. The box of claim 3 wherein the second sidewall defines an elongated, linear recess.

5. The box of claim 3 wherein the second sidewall defines an X-shaped recess.

6. The box of claim 1 wherein the first sidewall comprises a pair of first sidewall portions, hingedly joined to the third and the fourth sidewalls, respectively, and meeting along a joint line.

7. The box of claim 6 wherein the first sidewall portions include locking flaps locking with the spacer walls.

* * * * *